US007476631B2

(12) United States Patent
Barnholtz et al.

(10) Patent No.: US 7,476,631 B2
(45) Date of Patent: Jan. 13, 2009

(54) DISPERSIBLE FIBROUS STRUCTURE AND METHOD OF MAKING SAME

(75) Inventors: Steven Lee Barnholtz, West Chester, OH (US); James Edwin Cartledge, Jr., Liberty Township, OH (US); Ronald Thomas Gorley, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 412 days.

(21) Appl. No.: 10/406,752

(22) Filed: Apr. 3, 2003

(65) Prior Publication Data

US 2004/0198114 A1 Oct. 7, 2004

(51) Int. Cl.
*D04H 13/00* (2006.01)
*D21H 13/12* (2006.01)

(52) U.S. Cl. ..... 442/408; 442/414; 442/416; 428/222; 162/141; 162/146; 162/148; 162/157.2; 162/158

(58) Field of Classification Search ..... 442/408, 442/414, 416; 428/222; 162/141, 146, 148, 162/157.2, 158
See application file for complete search history.

(56) References Cited

U.S. PATENT DOCUMENTS

| | | | | |
|---|---|---|---|---|
| 4,362,781 | A | 12/1982 | Anderson | |
| 5,500,281 | A | 3/1996 | Srinivasan et al. | |
| 5,690,790 | A * | 11/1997 | Headlam et al. | 162/175 |
| 5,952,251 | A | 9/1999 | Jackson et al. | |
| 5,972,805 | A * | 10/1999 | Pomplun et al. | 442/59 |
| 6,059,928 | A * | 5/2000 | Van Luu et al. | 162/111 |
| 6,132,557 | A * | 10/2000 | Takeuchi et al. | 162/141 |
| 6,187,141 | B1 * | 2/2001 | Takeuchi et al. | 162/127 |
| 6,319,863 | B1 | 11/2001 | Takeuchi et al. | |
| 6,361,784 | B1 * | 3/2002 | Brennan et al. | 424/402 |
| 6,433,245 | B1 * | 8/2002 | Bjorkquist et al. | 604/364 |
| 6,552,123 | B1 * | 4/2003 | Katayama et al. | 525/57 |
| 6,602,386 | B1 * | 8/2003 | Takeuchi et al. | 162/115 |
| 6,890,872 | B2 * | 5/2005 | Bond et al. | 442/414 |

FOREIGN PATENT DOCUMENTS

| | | |
|---|---|---|
| EP | 0 303 528 | 2/1989 |

(Continued)

OTHER PUBLICATIONS

Carraher, Jr. "Polymer Chemistry, an Introduction" 4th ed, Marcel Dekker, Inc., 1996, p. 7, 505.*

(Continued)

*Primary Examiner*—Eric Hug
*Assistant Examiner*—Dennis Cordray
(74) *Attorney, Agent, or Firm*—Peter D. Meyer; David K. Mattheis

(57) ABSTRACT

A dispersible fibrous structure having an in-use wet tensile strength of at least about 40 g/cm; a disposable wet tensile decay of at least about 35% and a method of making the structure. The structure has at least one property selected from a group consisting of: a wet CD maximum slope of less than about 12 kg/7.62 cm, a wet CD Elongation of greater than about 50%, a low elongation CD modulus of less than about 5.0 kg/7.62 cm, and a wet CD Bending of less than about 0.05 gf cm/cm.

26 Claims, 2 Drawing Sheets

FOREIGN PATENT DOCUMENTS

| | | | |
|---|---|---|---|
| EP | 0 582 123 | | 2/1994 |
| EP | 0 671 496 | | 9/1995 |
| EP | 0 945 536 | | 9/1999 |
| EP | 1 285 985 | | 2/2003 |
| JP | 02068397 | A * | 3/1990 |
| JP | 8003848 | | 1/1996 |
| JP | 2001-123369 | | 5/2001 |
| WO | WO 96/30576 | | 10/1996 |
| WO | WO 01/31103 | | 5/2001 |
| WO | WO 02/22352 | | 3/2002 |
| WO | WO 02/060497 | | 8/2002 |

OTHER PUBLICATIONS

Derwent Abstract of JP-2604433-B2.*

Machine translation of JP-2604433 B2, The Industrial Property Digital Library (IPDL) PAJ index, [online], [retrieved on Dec. 20, 2007]. Retrieved from the Internet: <URL: http://www19.ipdl.inpit.go.jp/PA1/cgi-bin/PA1INDEX>.*

Certified English Translation of JP-2604433.*

Product Property Sheet for "KURALON K-II®" water soluble polyvinyl alcohol fibers [online], Kuraray Company, Jun. 24, 2002 [retrieved on Jul. 28, 2007], Retrieved from the Internet via the Internet Archive Wayback Machine: <URL:http://web.archive.org/web/*/http://www.kuraray.co.jp/kii/english/13.html>.*

Derwent Abstract of JP-2604433-B2, Mar. 7, 1990.*

Certified English Translation of JP-2604433, Mar. 7, 1990.*

* cited by examiner

DISPERSIBLE FIBROUS STRUCTURE AND METHOD OF MAKING SAME

FIELD OF THE INVENTION

The invention relates to dispersible non-woven structures. More particularly, the invention relates to a soft, flushable, non-woven structure having high in-use wet tensile strength and low wet tensile strength after disposal.

BACKGROUND OF THE INVENTION

Non-woven structures are a ubiquitous part of daily life. Non-woven structures are used for cleaning surfaces, such as glass and ceramic tile, and for cleaning the skin of children and adults. Pre-moistened, or wet, non-woven structures are also well known. One aspect of non-woven structures currently in use is the relatively high strength of the wet structures at the time of disposal of the soiled structure. This high strength precludes flushing the wipe into the sewage stream without the risk of clogging the system. A wet structure that has sufficient strength to accomplish the intended cleaning task, and which has a reduced strength upon being disposed is desired.

SUMMARY OF THE INVENTION

A dispersible fibrous structure having a total in-use wet tensile strength of at least about 40 g/cm according to the Total in-use wet tensile test method described herein. The structure has a disposable wet tensile decay of at least about 35% according to the disposable wet tensile decay test method described herein. The dispersible fibrous structure may comprise a binding fiber. The binding fiber may comprise a polyvinyl alcohol fiber. In one embodiment the fibrous structure has at least one property selected from a group consisting of: a wet CD maximum slope of less than about 12 kg/7.62 cm, a wet CD elongation of greater than about 50%, a low elongation CD modulus of less than about 5.0 kg/7.62 cm, a wet CD bending of less than about 0.05 gf*cm/cm, all of which can be determined according to the respective test methods as described herein.

The invention further comprises a method of making dispersible fibrous structures. In one embodiment the method comprises steps of laying down a fibrous structure wherein at least 1% of the fibers comprise binding fibers, wetting the fibrous structure, drying the fibrous structure, and rewetting the fibrous structure with a lotion wherein the lotion comprises at least one compound selected from a group consisting of water soluble organic salts, water soluble inorganic salts, and boron compounds.

DETAILED DESCRIPTION OF THE INVENTION

A dispersible fibrous structure with a total in-use wet tensile strength, and a disposable wet tensile decay is provided by the present invention. The total in-use wet tensile strength is the tensile strength of the structure measured when the structure has been prepared for its intended use, defined as the "in-use" condition of the structure. The structure is considered to be in its "in-use" condition when the base structure has been combined with a lotion and with a solubility inhibitor. The solubility inhibitor may be applied separately or as part of the lotion. The total in-use wet tensile strength is measured as described in the Test Methods section. In one embodiment, the total in-use wet tensile strength is at least about 40 g/cm. In another embodiment, the total in-use wet tensile strength is at least about 100 g/cm. In another embodiment, the total in-use wet tensile strength is at least about 200 g/cm. In another embodiment, the total in-use wet tensile strength is at least about 400 g/cm.

The structure may be disposed of by placing it in the aqueous environment of toilet bowl and flushing the bowl contents into the sewage system. The wet tensile strength of the structure decays when the structure is placed in the aqueous environment. This wet tensile decay reduces the in-use wet tensile by at least about 35%. In another embodiment, the wet tensile decay is at least about 40%. In another embodiment the wet tensile decay is at least about 50%. In yet another embodiment, the wet tensile decay is at least about 60%. The disposable wet tensile decay is determined according to the disposable wet tensile decay test method described herein.

The disposable wet tensile decay may be determined about 24 hours or less after the disposal of the structure. In another embodiment, the disposable wet tensile decay may be measured about 12 hours or less after the disposal of the structure. In another embodiment, the disposable wet tensile decay may be determined about 60 minutes or less after the disposal of the structure. In another embodiment, the disposable wet tensile decay may be determined about 30 minutes or less after the disposal of the structure. In another embodiment, the disposable wet tensile decay may be determined about 1 minute or less after the disposal of the structure.

The structure of the invention may optionally be further defined by at least one property selected from a group consisting of: a wet Cross-Direction (CD) maximum slope of less than about 12 kg/7.62 cm, a wet CD elongation of greater than about 50%, a low elongation CD modulus of less than about 5.0 kg/7.62 cm, and a wet CD bending of less than about 0.05 gf cm/cm. Each of the above mentioned properties is measured as described hereinafter in according to their respective test methods.

Figure 1:
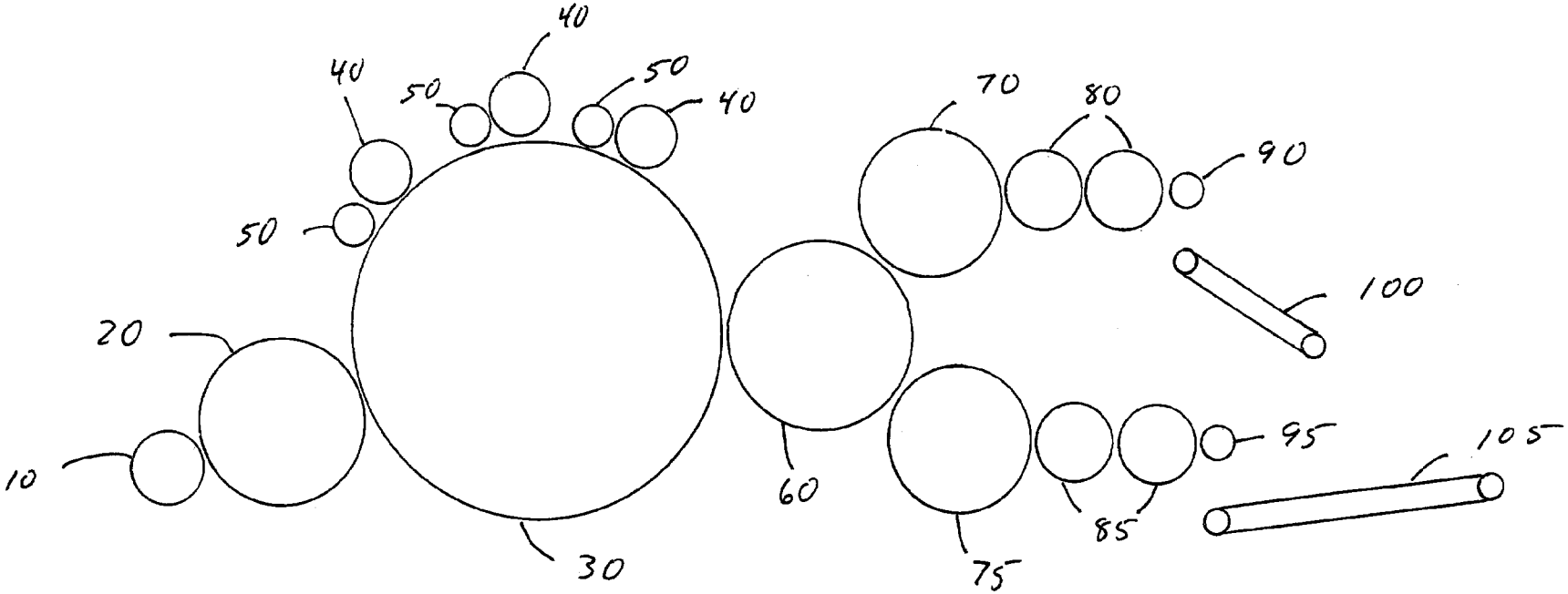
FIG. 1 schematically shows a process for making a structure of the invention.

FIG. 1 provides a schematic view of a process for making a base structure of the invention. According to FIG. 1, fibers are transferred from a feed roller 10 to a lickerin 20, to the main cylinder 30. The fibers are removed from the main cylinder 30 and redeposited on the main cylinder 30 with a substantially uni-directional orientation by the action between the surfaces of the main cylinder 30 and the worker cylinders 40. Residual fibers on the surface of the worker cylinders 40 are stripped from the worker cylinders 40 and redeposited on the main cylinder 30 prior to the worker cylinder 40 by the action between the surfaces of the stripper cylinders 50 and the worker cylinders 40. These steps result in carded fibers.

The carded fibers are removed from the main cylinder 30 by centripetal and aerodynamic forces between the surfaces of the main cylinder 30 and the randomizer cylinder 60. The randomizer cylinder 60 rotates in the direction opposite to that of the main cylinder 30. The randomizer cylinder 60 rotates at a speed such that the surface of the randomizer cylinder 60 is greater than the surface speed of the main cylinder 30. Because the fibers are transferred from the main cylinder 30 to the randomizer cylinder 60 by centripetal and aerodynamic forces, the fibers are reoriented and take on a random orientation on the randomizer cylinder 60. The randomized fibers are removed from the randomizer cylinder 60 by the action of the upper doffer cylinder 70, and the lower doffer cylinder 75. The fibers are then transferred from the upper doffer 70 and the lower doffer 75 to the upper condensing cylinders 80 and the lower condensing cylinders 85. The area weight of the structure is affected by the relative surface speeds of the doffer and condensing cylinders 70, 75, 80 and 85.

The fibers are then transferred from the upper and lower condensing cylinders 80, 85, to the upper doffmaster 90, and the lower doffmaster 95, respectively. The fibers are then transferred from the upper and lower doffmasters 90, 95, to the upper conveyor 100, and lower conveyor 105, respectively. The fibers are then combined by the transfer of fibers from the upper conveyor 100 to the lower conveyor 105.

In one embodiment, at least about 1% of the fibers in the base structure comprise binding fibers. In another embodiment, the base structure comprises at least about 10% by weight of binder fibers. In another embodiment, the base structure comprises at least about 20% by weight binder fibers. In another embodiment, the base structure comprises at least about 30% by weight of binder fibers. In another embodiment, the base structure comprises at least about 40% by weight of binder fibers. In still another embodiment the base structure comprises at least about 50% by weight binder fibers. The binding fibers interact with one another and with the non-binding fibers when the structure is wetted as described below. These interactions impart tensile strength to the structure. Exemplary binding fibers include polyvinyl alcohol (PVA) fibers. Non-binding fibers may also interact to impart tensile strength but to a lesser degree than the binding fibers.

Standard PVA fibers are soluble in water at temperatures of about 90° C., low water temperature soluble PVA fibers are available. In one embodiment, the structure 200 comprises PVA fibers having a water solubility temperature of about 40° C. In another embodiment, the structure 200 comprises PVA fibers having a water solubility temperature of about 50° C. In another embodiment, the structure 200 comprises PVA fibers having a water solubility temperature of about 70° C. Exemplary PVA fibers are available as Kuralon II PVOH fibers: WN4, WN5, and WN7. These fibers are available from Kuraray Co. Ltd., Fibers and Industrial Materials Company, 1-12-39 Umeda, Kita-ku, Osaka 530-8611, Japan.

The base structure may be formed by carding, air laying, or wet laying as these processes are known in the art.

The base structure may comprise a single layer, as described above, or multiple layers with at least one layer as described above. Additional non-binding fibers may be added to the carded base structure. Additional fibers may be air laid onto the base layer after the carding process. In one embodiment a previously formed structure of fibers can be added before or after one or more cards to form a layer of fibers in the base structure. Exemplary fibers that may be added include, but are not limited to: natural fibers including cotton fibers and wood pulp fibers, and synthetic fibers including thermoplastic fibers, glass fibers, and polymeric fibers. These fibers may be added on a single layer of carded fibers or between multiple layers of carded fibers. In one embodiment the base structure comprises a homogeneously blended layer of different fibers. In another embodiment the base structure comprises multiple layers of different fibers or of different fiber blends. Multiple cards and multiple fiber addition stations may be utilized to achieve the desired combination of layers per ply and fiber constituents per layer.

The structure 200 may further comprise other fibers including but not limited to, glass fibers and synthetic polymeric fibers. Synthetic polymeric fibers useful herein include polyolefins, particularly polyethylenes, polypropylene and copolymers having at least one olefinic constituent. Polyesters, polyamides, nylons, rayons, lyocells, copolymers thereof and combinations of any of the foregoing may be useful in the structures 200 of the invention.

Thermoplastic fibers, such as polyolefins (e.g., polyethylene and polypropylene), polyesters, polyamides, polyimides, polyacrylates, polyacrylonitrile, polylactic acid, polyhydroxyalkanoate, polyvinyl alcohol, polystyrene, polyaramids, polysaccharides and blends and co-polymers thereof and thermoplastic powders such as polypropylene power, may also be added to the structure and then heat set, as is known in the art, to provide additional initial tensile strength. Fibers may comprise single or multi-components of said thermoplastic polymers. Examples of multicomponent fibers include but are not limited to fibers comprising a sheath/core, side-by-side, islands-in-the-sea construction of at least two different materials selected from the thermoplastic fibers.

Digested cellulose fibers from softwood (derived from coniferous trees), hardwood (derived from deciduous trees) or cotton linters may be utilized. Fibers from Esparto grass, bagasse, kemp, flax, and other lignaceous and cellulose fiber sources may also be utilized as raw material in the invention. The structure 200 may comprise wood pulps including chemical pulps, such as Kraft (i.e., sulfate) and sulfite pulps, as well as mechanical pulps including, for example, ground wood, thermomechanical pulp (i.e., TMP) and chemithermomechanical pulp (i.e., CTMP). Completely bleached, partially bleached and unbleached fibers may be used.

Also useful in the present invention are fibers derived from recycled paper, which can contain any or all of the above categories as well as other non-fibrous materials such as fillers and adhesives used to facilitate the original paper making process.

The base structure is then wetted. The base structure may be wetted by exposing the structure to hydroentangling jets of water. In one embodiment, the water of the hydroentangling jets has a temperature less than the water solubility temperature of the binding fibers in the structure. In another embodiment the water of the hydroentangling jets has a temperature equal to or greater than the solubility temperature of the binding fibers of the structure. In this embodiment, the hydroentangling water may be conditioned with a salt or other solubility-inhibiting agent to prevent the water absorption by the binding fibers, or the binding fibers may be reconditioned with a solubility-inhibiting agent to prevent water absorption by the binding fibers.

Figure 2:
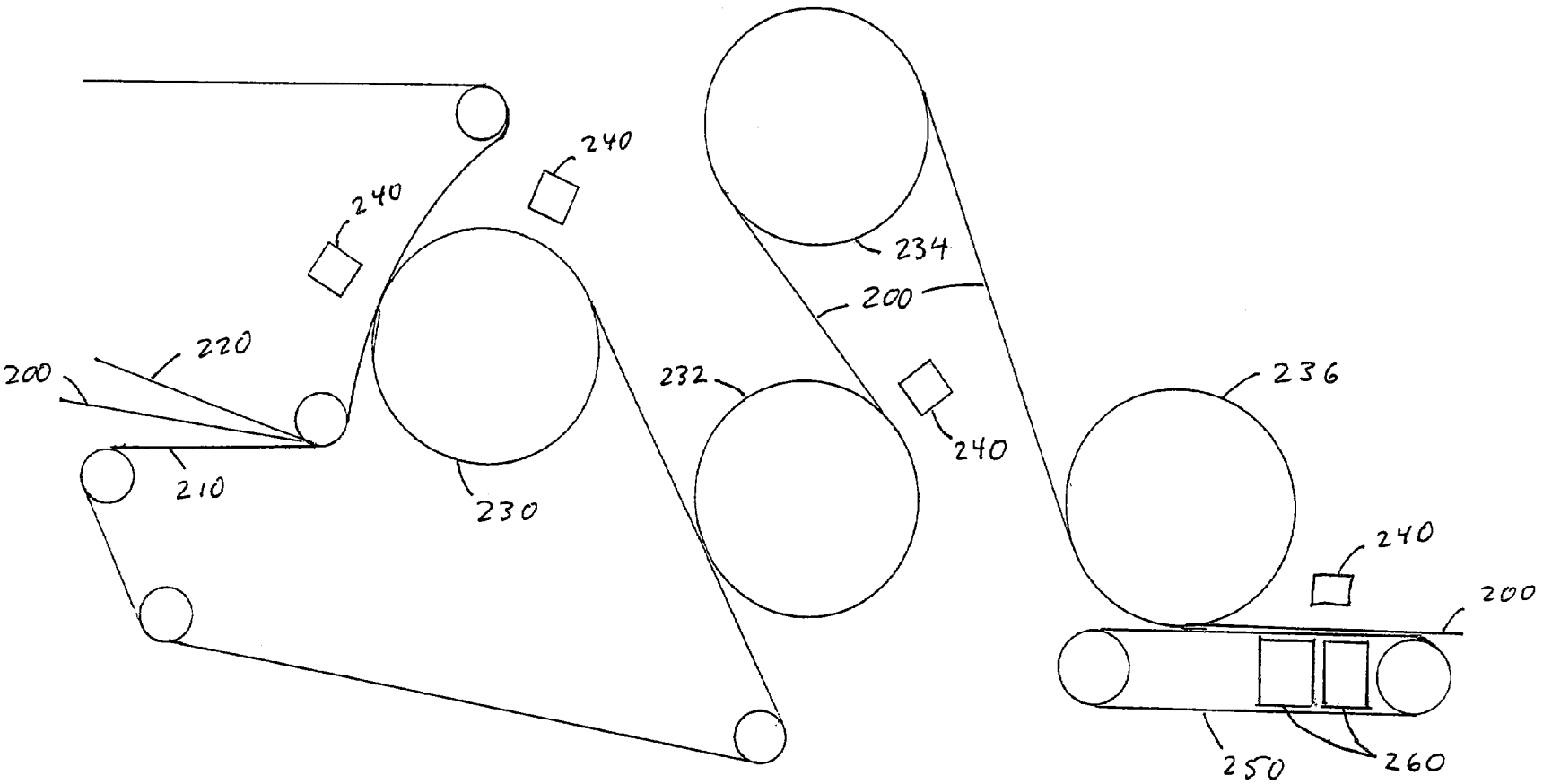
FIG. 2 schematically shows a process for wetting a structure of the invention.

FIG. 2 illustrates schematically a process for wetting the structures of the invention. According to FIG. 2, the base structure 200, is supported between carrier fabrics 210, and 220. The structure is routed around a first vacuum roll 230, and is wetted by hydroentangling jets 240. The hydroentangling jets 240, impart energy to the fibers of the structure 200 causing the fibers to intermingle and mechanically bind together.

Without being bound by theory, we believe that the hydroentangling jets 240, should impart sufficient energy to the structure 200 to entangle the binding fibers. In a structure 200 comprising binding fibers and non-binding fibers, the binding fibers will become entangled at a lower energy than the non-binding fibers. The tensile strength of this structure 200 is the result of the hydroentangled binding fibers. When the bonding of the binding fibers is reduced the strength of the structure 200 decays.

The wetted structure 200 is then dried. First vacuum roll 230, second vacuum roll 232, third vacuum roll 234, and fourth vacuum roll 236, have a porous outer surface and an inner volume that is interconnected to a source of vacuum (not shown). The vacuum rolls are used to remove water from the wetted structure. The structure is routed from the vacuum rollers 230, 232, 234, and 236, to a conveyor 250, where vacuum boxes 260, are used to remove additional water from the structure 200. The structure 200 is then routed through an oven (not shown) for final drying. The structure 200 may be dried according to any process known in the art. Drying processes include, but are not limited to, through-air drying, vacuum drying, ultrasonic drying, and infrared drying.

The dried structure 200 is then rewetted with a lotion. In one embodiment, the structure 200 is wetted to an equilibrium moisture level of about 100% to about 500% of the dry weight of the structure. In another embodiment, the structure is wetted to an equilibrium moisture content of 200% to 400% of the dry weight of the structure. In yet another embodiment, the structure is wetted to an equilibrium moisture content of about 250% to about 300% of the dry weight of the structure. The structure may be rewetted with lotion by methods including, but not limited to, saturation, spraying, and printing, as these methods are known in the art.

In one embodiment the structure 200 comprises low water temperature soluble polyvinyl alcohol (PVA) fibers as binding fibers. The binding fibers are affected by fresh water at temperatures below the water solubility temperature of the fibers. Without being bound by theory, Applicants believe that when the binding fibers are exposed to substantial amounts of water, the fibers may absorb water and swell. Swelling disrupts the bonds of the binding fibers and reduces the tensile strength of the structure.

Accordingly, the absorption of water by the binding fibers from the lotion or during the use of the structure must be impaired or prevented to maintain a high in-use wet tensile strength. To impair or prevent this absorption, a solubility inhibitor is added to the structure. The solubility inhibitor interacts with the binding fibers and impairs or prevents the fibers from absorbing water when exposed to small amounts of water in the lotion and during the use of the structure. When the structure is disposed into the relatively large quantity of water of the toilet bowl, the insolubility interactions are reduced as the solubility inhibitor in the structure is diluted into the relatively large volume of water of the bowl. As the inhibitor concentration in the structure decreases, the binding fibers are more able to absorb water. As the binding fibers absorb water, the tensile strength of the structure is reduced as described above.

Solubility inhibitors include but are not limited to: water-soluble organic salts, water-soluble inorganic salts, and water-soluble boron compounds.

Exemplary water soluble organic salts include, but are not limited to, carboxylates selected from the group consisting of sodium tartrate, potassium tartrate, sodium citrate, potassium citrate, sodium malate, and potassium malate Exemplary water soluble inorganic salts useful herein include, but are not limited to, sodium sulfate, potassium sulfate, ammonium sulfate, zinc sulfate, copper sulfate, iron sulfate, magnesium sulfate, aluminum sulfate, potash alum, ammonium nitrate, sodium nitrate, potassium nitrate, aluminum nitrate, sodium chloride, potassium chloride, and the like.

Boron compounds of use in the structures of the invention include, but are not limited to: boric acid, and borax.

The level of solubility inhibitor directly affects the in-use wet tensile strength of the structure. The level of solubility inhibitor required for a given structure will be dictated by the fiber composition of the structure and the desired end use of the structure. Structures comprising more binding fibers and desiring a higher in-use tensile strength will require a higher level of solubility inhibitor.

The solubility inhibitor may be applied to the structure as a constituent of the lotion. The solubility inhibitor may be applied separately from the lotion by methods including, but not limited to, spraying, printing, and saturation.

In-use wet tensile strength may be altered by the presence of liquid binders as are known in the art. The liquid binder augments the binding of the PVA fibers. The liquid binder may be applied to the structure by any means known in the art. Exemplary means include, but are not limited to, saturation, froth bonding, extrusion, foaming, printing, and spraying. Latex is an exemplary liquid binder. A commercially available example of such a latex would include Rhoplex TR-520 from Rohm and Haas. Another exemplary liquid binder comprises a water soluble polymeric composition having from about 25% by weight to about 90% by weight of an unsaturated carboxylic acid/carboxylic acid ester terpolymer; from about 10% by weight to about 75% by weight of a divalent ion inhibitor; and can have from about 0% by weight to about 10% by weight of a plasticizer. The liquid binder can be added at a rate of from about 1% by weight to about 40% by weight of the dry structure.

As used herein, the term "divalent ion inhibitor" means any substance that inhibits the irreversible cross-linking of the acrylic acids in the base terpolymer by divalent ions. Exemplary divalent ion inhibitors include, but are not limited to, sulfonated copolyester, polyphosphate, phosphoric acid, aminocarboxylic acid, hydroxycarboxilic acid, polyamine and the like.

Plasticizers may be added to the structure, either as part of a liquid binder or separately, to increase the flexibility of the fibers and to increase the softness of the structure. Exemplary plasticizers include, but are not limited to, glycerol, sorbitol, emulsified mineral oil, dipropyleneglycoldibenzoate, polyglycols such as polyethylene glycol, polypropylene glycol, and copolymers thereof, decanoyl-N-methyl glucamide, tributyl citrate, tributoxyethyl phosphate and the like.

The structure of the invention may be provided as a single ply, or as a multiple ply structure. A multiple ply embodiment may comprise a single ply as described above in combination with a dissimilar ply. Exemplary dissimilar plies include but are not limited to, wet laid cellulosic structures, non-woven structures other than as described above, polymeric films, metal films and combinations thereof. In another multiple ply embodiment, the respective plies are each a structure of the invention as described above.

The plies of a multiple ply embodiment may be joined to one another by any means known in the art. Non-limiting means include embossing, thermal bonding and adhesive bonding on the plies.

The structure of the invention may be provided as a roll or folded stack of "in-use" structure material with or without segmenting lines of weakness between portions of the roll. The structure may be provided as a stack of individual sheets of structure material either interleaved with one another or stacked without interleaving.

The structure may be packed in a kit with a tub or other dispenser designed to reduce drying of the structure prior to use by the consumer. The packages of the structure may include instructions for proper use of the structures in a graphical form, textual form, or combination of graphics and text.

The structure may be provided as a kit with a semi-durable or durable dispensing unit and also packaged as a refill for such a dispensing unit. Refill packages may be identified with similar indicia as the combination of the dispenser and structures.

The structure may be moistened with a range of lotions depending upon the intended use for the final product. Lotions suitable for personal cleansing, hard surface cleansing, polishing or finish coating may be used. In one embodiment, the lotion used to moisten the structure comprises a solubility inhibitor as described herein. in another embodiment, the lotion is applied to the structure in combination with a separate solubility inhibitor. In another embodiment, the lotion is applied to the structure separately from the solubility inhibitor.

EXAMPLE 1

A structure comprising 13% Kuralon K-II WN5 PVA fibers, 33% by weight wood pulp, and 54% viscose rayon fibers was produced using the process illustrated in FIG. 2 as described above. The wood pulp fibers were air-laid onto a carded structure comprising the viscose and PVA fibers.

The structure was then hydroentangled using a process illustrated schematically in FIG. 3, as described above. The specific energy of the first, second, and third hydroentangling jets were adjusted to 0.006, 0.030, and 0.016 kwh/kg respectively.

The hydroentangled structure was then dried by passing through an oven at 130° C. with the amount of inlet fresh air minimized in order to maximize the relative humidity in the oven while still drying the structure completely.

The structure was then wetted as described in the test methods section, with a lotion comprising 7.1% by weight, sodium sulfate.

The relevant physical properties of the example structure are summarized in Table 1.

TABLE 1

| Test Method | Example 1 | Units |
|---|---|---|
| Total In-Use Wet Tensile | 480 | g/cm |
| Total Initial Lotioned Wet Tensile | 540 | g/cm |
| % Wet Tensile Decay (1 minute) | 70.8 | % |
| Wet CD Elongation | 111 | % |
| Low Elongation CD Modulus | 1.60 | Kg/7.62 cm |
| Wet CD Maximum Slope | 9.82 | Kg/7.62 cm |
| Wet CD Bending | 0.0472 | gf*cm/cm |

Test Methods

Total In-Use Wet Tensile Testing:

A Thwing-Albert EJA tensile tester model 1376-18 available from the Thwing-Albert Instrument Company, Philadelphia, Pa., is utilized. Settings include a gauge length of 5.08 cm a crosshead speed of 10.16 cm/min, a break sensitivity of 20 g, 2.54 cm sample strip, 1 strip tested at a time. The unit takes 20 readings/sec and does not take readings for stretch measurement until 11.12 g of load is obtained. The "In-Use Wet Tensile" is taken at least 24 hours after the structure is in an in-use condition, at a moisture level of 200-400% based on the dry substrate weight. The peak load reached describes the Initial Wet Tensile. This test is performed on a minimum of four different samples both in the MD and CD. The Total In-Use Wet Tensile is the sum of the Average MD and Average CD In-Use Wet Tensile.

Total Initial Lotioned Wet Tensile:

The Initial Lotioned Wet Tensile can be obtained immediately after wetting the substrate with its in-use lotion and solubility inhibitor; however, in this method, there is insufficient time for a sample to reach equilibrium moisture level at the desired 200%-400% moisture level. Therefore when testing the Initial Lotioned Wet Tensile, the dry product is submerged for 5 seconds in the in-use wetting lotion, placed on a BOUNTY paper towel for 5 seconds then immediately placed into the Thwing-Albert model 1376-18 and tested as described in the Total In-Use Wet Tensile test. This test is performed on a minimum of four different samples both in the MD and CD. The Total Initial Lotioned Wet Tensile is the sum of the Average MD and Average CD Initial Lotioned Wet Tensiles.

Total Decayed Wet Tensile:

Sample strip of 2.54 cm width and approximately 15 cm length is pre-cut from "in-use" lotioned sample between 200% lotion and 400% lotion based on substrate dry weight. The sample strip is cut from sample that has been in the "in-use" condition for at least about 24 hours. A 1000 mL beaker is filled with 800 ml dilution water at 73° F.+/−2° F. (23° C. +/−1° C.) containing less than 200 ppm divalent ion. The pre-cut sample is then placed in the 800 mL water for the specified time interval also known as the time after disposal. These times after disposal include 1 minute, 30 minutes, 12 hours, or 24 hours. The sample is then removed from the dilution water and immediately placed in the jaws of the Thwing-Albert model 1376-18. A decayed tensile is then obtained using identical settings as in the total in-use wet tensile test. The dilution water is replaced after every 5 samples tested. A minimum of four samples both in the MD and CD directions are tested. The Total Decayed Wet Tensile is the sum of the average MD and average CD Decayed Wet Tensile tests.

Disposable Wet Tensile Decay:

The Disposable Wet Tensile Decay is calculated by the following equation.

(Total In-Use Wet Tensile−Total Decayed Wet Tensile)/Total In-Use Wet Tensile*100.

Wet CD Elongation:

Wet CD elongation is calculated by taking the displacement at peak load of the in-use wet tensile test and dividing by the gauge length and multiplying by 100. As noted above, the Thwing-Albert model 1376-18 does not begin to determine the length of displacement until 11.2 g of load is reached. This assures that elongation is not being measured on a loosely loaded sample.

Low Elongation CD Modulus

Product is placed in in-use lotion and aged for at least 24 hours at 73° F. (23° C.). Lotion loading is between 200% and 400% based on weight of dry substrate. A 7.62 cm sample strip is taken from the Cross Machine direction. A 5.08 cm gauge length is utilized and the crosshead speed is 25.4 cm/min. Data is taken every 0.0125"±0.001" (0.3 mm) of displacement and output is in kg/7.62 cm sample width. A least squares regression is performed on the data. A loading of at least 0.0112 kg/7.62 cm sample should be obtained within the first 0.025" of displacement. Should this not be the case (e.g. the sample is loaded loosely in the tensile tester), data before 0.0112 kg/7.62 cm sample should be deleted/ignored and the displacement distance set to zero once 0.0112 kg/7.62 cm is reached. The slope is measured of the least squares regression between the points of 0.62"±0.01" (31%±0.5%)

and 0.80"±0.01" (40%±0.5%) of displacement. At least 4 different samples are tested and their respective slopes averaged. This slope of the least squares regression through the data between 31% and 40% elongation is the Low Elongation CD Modulus. The units are kg/7.62 cm as the strain is dimensionless since the length of elongation is divided by the length of the jaw span.

Wet CD Maximum Slope:

From the same load vs. elongation data as the Low Elongation CD Modulus test, two points P1 and P2 are selected that lie along the load/elongation curve. The Thwing-Albert model 1376-18 is programmed such that it calculates a linear regression for the points that are sampled from P1 to P2. This calculation is done repeatedly over the curve by adjusting the points P1 and P2 in a regular fashion along the curve. The highest value of these calculations is the Wet CD Maximum Slope. The Thwing-Albert model 1376-18 is programmed such that data is obtained every 0.0125" of displacement. The program calculates the slope along these points by setting the $10^{th}$ point as the initial point (for example P1), counting thirty points to the $40^{th}$ point (for example, P2) and performing a linear regression on those thirty points. The slope is then stored in an array. The program then counts up 10 points to the $20^{th}$ point (which becomes P1) and repeats the procedure again (counting 30 points to what would be the $50^{th}$ point (which becomes P2), calculating that slope and also storing it in the array.) This process continues for the entire elongation of the sheet. The Wet CD Max Slope is then chosen as the highest value from this array. The units on the Wet CD Max Slope are kg/7.62 cm specimen width. A minimum of four different samples is tested and their respective Wet CD Max Slopes are averaged.

Wet CD Bending:

Product is in its "in-use" state with in-use lotion add-on of 200-400% based on the dry weight of the substrate. The product has been in in-use lotion for at least 24 hours to allow for moisture equilibration while being stored at 73° F.+/−2° F. (23° C.+/−1° C.). Kawabata Pure Bending Measurement Tester Model: KES FB 2-A (hereafter described as "Kawabata") is used. Four samples are cut 10 cm×10 cm in size. Samples are tested in the Weft or Cross Machine Direction (CD). The setting of "K-Span" should be on "SET" and the sensitivity, "SENS*", should be on 20 on the tester and 2×1 on the computer. Should the material be too stiff the sensitivity may be switched to 50 on tester and 5×1 on computer. The test is performed according to the protocol included in the Kawabata to measure the Bending force and the data are in the units of gf cm/cm. The four samples are tested and an average of those samples is obtained. The average of these samples describes the Wet CD Bending.

What is claimed is:

1. A hydroentangled dispersible fibrous structure comprising intermingled and mechanically bound fibers, said dispersible fibrous structure further comprising solvent spun binding fibers having a water solubility temperature of less than about 70 degrees centigrade, said dispersible fibrous structure further comprising at least one ply and having no externally applied binders disposed thereupon, the ply having a total in-use wet tensile strength of at least about 40 g/cm; a disposable wet tensile decay of at least about 35%; wherein the disposable wet tensile decay is determined about 24 hours or less after disposal of the structure, and a wet CD maximum slope of less than about 12 kg/7.62 cm.

2. The dispersible fibrous structure of claim 1 wherein the disposable wet tensile decay is determined about 12 hours or less after disposal of the structure.

3. The dispersible fibrous structure of claim 1 wherein the disposable wet tensile decay is determined about 30 minutes or less after disposal of the structure.

4. The dispersible fibrous structure of claim 1 wherein the disposable wet tensile decay is determined about 1 minute or less after disposal of the structure.

5. The dispersible fibrous structure of claim 1 comprising a ply having a total in-use wet tensile strength of at least about 200 g/cm.

6. The dispersible fibrous structure of claim 1 comprising a ply having a total in-use wet tensile strength of at least about 400 g/cm.

7. The dispersible fibrous structure of claim 1 comprising a divalent ion inhibitor.

8. The dispersible fibrous structure of claim 1 comprising a plasticizer.

9. The dispersible fibrous structure of claim 1 wherein the structure comprises a hydroentangled nonwoven.

10. The dispersible fibrous structure of claim 1 wherein the structure comprises an airlaid nonwoven.

11. The dispersible fibrous structure of claim 1 comprising thermoplastic fibers.

12. The dispersible fibrous structure of claim 1 further comprising at least one compound selected from a group consisting of: a water-soluble organic salt, a water-soluble inorganic salt, and a boron compound.

13. The dispersible fibrous structure of claim 1 wherein the structure has a wet CD Elongation of greater than about 50%.

14. The dispersible fibrous structure of claim 1 wherein the structure has a low elongation CD modulus of less than about 5.0 kg/7.62 cm.

15. The dispersible fibrous structure of claim 1 wherein the structure has a wet CD Bending of less than about 0.05 gf cm/cm.

16. A hydroentangled dispersible fibrous structure comprising intermingled and mechanically bound fibers, said dispersible fibrous structure further comprising solvent spun binding fibers having a water solubility temperature of less than about 70 degrees centigrade, the dispersible fibrous structure further comprising at least one ply and having no externally applied binders disposed thereupon, the ply having a total in-use wet tensile strength of at least about 40 g/cm; a disposable wet tensile decay of at least about 35%; wherein the disposable wet tensile decay is determined about 24 hours or less after disposal of the structure, and a low elongation CD modulus of less than about 5.0 kg/7.62 cm.

17. The dispersible fibrous structure of claim 16 wherein the disposable wet tensile decay is determined about 12 hours or less after disposal of the structure.

18. The dispersible fibrous structure of claim 16 comprising a ply having a total in-use wet tensile strength of at least about 200 g/cm.

19. The dispersible fibrous structure of claim 16 further comprising at least one compound selected from a group consisting of: a water-soluble organic salt, a water-soluble inorganic salt, and a boron compound.

20. The dispersible fibrous structure of claim 16 wherein the structure has a wet CD maximum Elongation of greater than about 50%.

21. The dispersible fibrous structure of claim 16 wherein the structure has a wet CD Bending of less than about 0.05 gf cm/cm.

22. A hydroentangled dispersible fibrous structure comprising intermingled and mechanically bound fibers, said dispersible fibrous structure further comprising at least one ply, the ply comprising solvent spun binding fibers having a water solubility temperature of less than about 70 degrees centigrade, the ply having no externally applied binders thereon, the ply having a total in-use wet tensile strength of at least about 40 g/cm; a disposable wet tensile decay of at least about 35%; and wherein the disposable wet tensile decay is determined about 24 hours or less after disposal of the structure and a wet CD Bending of less than about 0.05 gf cm/cm.

23. The dispersible fibrous structure of claim 22 wherein the disposable wet tensile decay is determined about 30 minutes or less after disposal of the structure.

24. The dispersible fibrous structure of claim 22 comprising a ply having a total in-use wet tensile strength of at least about 400 g/cm.

25. The dispersible fibrous structure of claim 22 comprising thermoplastic fibers.

26. The dispersible fibrous structure of claim 22 wherein the structure has a wet CD Elongation of greater than about 50%.

* * * * *